US007048110B2

(12) United States Patent
Hachiya et al.

(10) Patent No.: US 7,048,110 B2
(45) Date of Patent: May 23, 2006

(54) PRINTING CONVEYOR SYSTEM

(75) Inventors: Tadashi Hachiya, Hyogo (JP); Kaoru Fujisawa, Kyoto (JP); Kouichi Morita, Osaka (JP)

(73) Assignees: Kabushiki Kaisha Tokyo Kikai Seisakusho, Tokyo (JP); Kaneda Kikai Seisakusho, Co., Ltd., Osaka (JP)

( * ) Notice: Subject to any disclaimer, the term of this patent is extended or adjusted under 35 U.S.C. 154(b) by 85 days.

(21) Appl. No.: 10/790,095

(22) Filed: Mar. 2, 2004

(65) Prior Publication Data

US 2005/0046103 A1 Mar. 3, 2005

(30) Foreign Application Priority Data

Aug. 25, 2003 (JP) ..... 2003-299804

(51) Int. Cl.
*B65G 47/84* (2006.01)

(52) U.S. Cl. ..... 198/470.1; 271/185; 271/204

(58) Field of Classification Search ..... 198/377, 198/469.1, 470.1; 271/184, 185, 204, 205, 271/206, 225
See application file for complete search history.

(56) References Cited

U.S. PATENT DOCUMENTS 5,007,624 A * 4/1991 Chandhoke ..... 271/204
5,380,000 A * 1/1995 Ohno ..... 271/204
5,727,783 A * 3/1998 Tassinari ..... 271/185
6,254,088 B1 7/2001 Kramer et al.
2002/0060410 A1 5/2002 Uera et al.

FOREIGN PATENT DOCUMENTS

JP 3046308 B1 3/2000
JP 2000-103557 A1 4/2000

OTHER PUBLICATIONS

European Search Report for application No. EP 04 10 0694 completed on Dec. 9, 2004.

* cited by examiner

*Primary Examiner*—James R. Bidwell
(74) *Attorney, Agent, or Firm*—Rader, Fishman & Grauer PLLC

(57) ABSTRACT

The conveyor system is disclosed as appended to a web-fed printing press, for transporting the completed signatures from a delivery fan to a stacking station. Included is a first conveyor having a pair of endless chains each having a series of first grippers in transverse alignment with their counterparts on the other endless chain. Each transversely aligned pair of first grippers conjointly grips, in a loading position immediately downstream of the delivery fan, a signature at two spaced points on one edge thereof and releases the same in a transfer position intermediate the delivery and stacking station. A second conveyor has but one endless chain with a series of second grippers mounted thereto. Each second gripper grips, in the transfer position, the signature at a point on the edge thereof intermediate the two spaced points where the signature has been gripped by one pair of first grippers on the first conveyor, and releases the signature at the stacking station. The two conveyors are driven independently of each other.

10 Claims, 9 Drawing Sheets

PRINTING CONVEYOR SYSTEM

BACKGROUND OF THE INVENTION

1. Field of the Invention

This invention relates generally to conveyor systems for articles such as printings. More particularly, the invention deals with a conveyor system to be appended to a web-fed printing press, in a position immediately downstream of the delivery fan, for transporting the completed printings, known to the specialists as signatures, to a subsequent processing station such as a stacking station.

2. Description of the Prior Art

Japanese Patent No. 3,046,308 teaches an integrated conveyor system for transporting signatures from a web folding and cutting station to a stacking station, with or without use of the delivery fan which is customarily employed for depositing the signatures from the folding and cutting station onto the conveyor one by one. This known conveyor system is in essence an endless chain with sets of wheels mounted to the chain links to roll along a looped guide rail. Each chain link is additionally furnished with a cooperative pair of grip fingers which open to receive an edge of a signature issuing from the folding and cutting station, which close to grip and carry the signature, and which reopen at the stacking station to release the signature.

This prior art chain conveyor had a weakness which manifested itself in the event of a jam of the signatures, particularly in the neighborhood of where the signatures were loaded on the conveyor by being gripped by the grip fingers. Being constituted of a single endless chain, the complete conveyor had to be set out of operation pending the system recovery from the trouble. All the signatures that had been being carried then by the endless chain conveyor had to be held at a standstill, blocked against further processing, until the conveyor resumed operation.

Japanese Unexamined Patent Publication No. 2000-103,557 suggests a conveyor system that incorporates two successive endless chain conveyors in order to defeat the weakness above. Both chain conveyors have gripping devices mounted to their links for engaging and carrying the signatures. The signatures are first loaded onto a first chain conveyor and thence onto a second chain conveyor for transportation to the subsequent processing station. The second chain conveyor has two endless chains parallel to each other, each carrying a row of gripping devices. At the junction between the first and the second chain conveyors, the two rows of gripping devices on the second lie on both sides of the row of gripping devices on the first. A belt conveyor is additionally provided for supporting the free edges of the signatures being carried by the first chain conveyor.

Only the first chain conveyor needs to be stopped in event a jam occurs at its loading end or upstream in this second prior art device. The signatures that have been carried by the second chain conveyor at that time can all be conveyed to the next station for continued processing.

The second prior art device has its own shortcomings. During transfer from the first to the second chain conveyor, the pair of gripping devices of the second conveyor are intended to engage the signature at its edge parts on both sides of where it is gripped by the first conveyor. However, as such edge parts are easy to sag while the signature is being carried by the first conveyor, the pair of gripping devices of the second conveyor sometimes failed to engage, or failed to engage correctly, the required edge parts of the signature. Then the signature either fell off the conveyor system or was ruined in the course of further processing. Human labor was required for recovery and disposal of such waste printings. The noted belt conveyor was incapable of totally eliminating such sagging of the signatures and, what is worse, itself added to the bulk of the printing system.

SUMMARY OF THE INVENTION

The present invention seeks to minimize the signatures that are held carried by the conveyor system, without being conveyed to the next processing station, when a jam or like trouble occurs in the neighborhood of its loading end or upstream.

Another object of the invention is to maintain each signature in a required attitude while being transferred from the first to the second conveyor and hence to assure the unfailing transfer of the signatures from the first to the second conveyor.

A further object of the invention is to make the complete conveyor system as compact and space-saving as feasible.

Briefly, the present invention may be summarized as a conveyor system for transportation of articles, such as signatures in a web-fed printing press, from a first to a second station. Included is a first conveyor having a pair of endless chains each having a series of first grippers mounted thereto in transverse alignment with first grippers of like construction on the other endless chain. Each transversely aligned pair of first grippers are capable of conjointly gripping an article at two spaced points on one edge thereof in a loading position adjacent the first station, and of releasing the article in a transfer position intermediate the first and the second station. A second conveyor is provided which has an endless chain with a series of second grippers mounted thereto. Each second gripper is capable of gripping, in the transfer position, an article at a point on the edge thereof intermediate the two spaced points where the article has been gripped by one pair of first grippers on the first conveyor, and of releasing the article at the second station. Means are provided for setting the first and the second conveyor into and out of operation independently of each other.

Thus, while being carried by the first conveyor from the first station to the transfer position, each signature is engaged by one transversely aligned pair of first grippers. The signature can be transferred from the first to the second conveyor in the correct attitude, as one of the second grippers on the second conveyor engages the signature at a point intermediate the two spaced points on its edges where it has been engaged by one pair of first grippers on the first conveyor. There is little or no likelihood of the second gripper failing to grip the signature by the sagging of its edge. The invention forgoes the belt conveyor which has been conventionally employed below the first conveyor for holding the signatures in the correct attitude, so that the conveyor system according to the invention is more compact and space-saving than heretofore.

Possibly, when the signature is loaded on the first conveyor from the delivery fan, its edge may have a slack between the points of engagement by one pair of first grippers on the first conveyor. The second gripper might then fail to grip the signature firmly enough. The invention precludes this possibility by making the pair of endless chains of the first conveyor diverge apart as they extend from the loading to the transfer position. The edge of the signature will then be stretched out by the pair of first grippers on the first conveyor while traveling toward the transfer position, and positively caught in the transfer position by one of the second grippers on the second conveyor.

It will also be appreciated that the invention provides for dependently setting the first and the second conveyor into and out of operation. When trouble such as the jamming of the web or signatures occurs at the delivery fan or upstream, for example, both conveyors may be individually started or stopped as required during the progress of troubleshooting. Also, in the event of such trouble, only the first conveyor may be stopped, and the second conveyor kept running to transport to the stacking station all the usable signatures that have been carried then by the second conveyor.

A further feature of the invention resides in a pair of transfer control cam associated with the second grippers on the second conveyor. Pivotable between two different positions as by a fluid-actuated cylinder under the control of a solenoid valve, the transfer control cams permit or block the transfer of the articles from the first to the second conveyor. This feature is intended to function during the startup period of the printing press, when faulty or incomplete signatures are unavoidably produced. The transfer control cams may then be positioned to block the transfer of the waste signatures from the first to the second conveyor. The waste signatures will be discharged under the unloading end of the first conveyor. After the press has started putting out good signatures, the transfer control cam may be actuated to permit transportation of such signatures to the stacking station.

The above and other objects, features and advantages of this invention will become more apparent, and the invention itself will best be understood, from a study of the following description and appended claims, with reference had to the attached drawings showing the preferred embodiment of the invention.

DESCRIPTION OF THE PREFERRED EMBODIMENT

General

Figure 1:
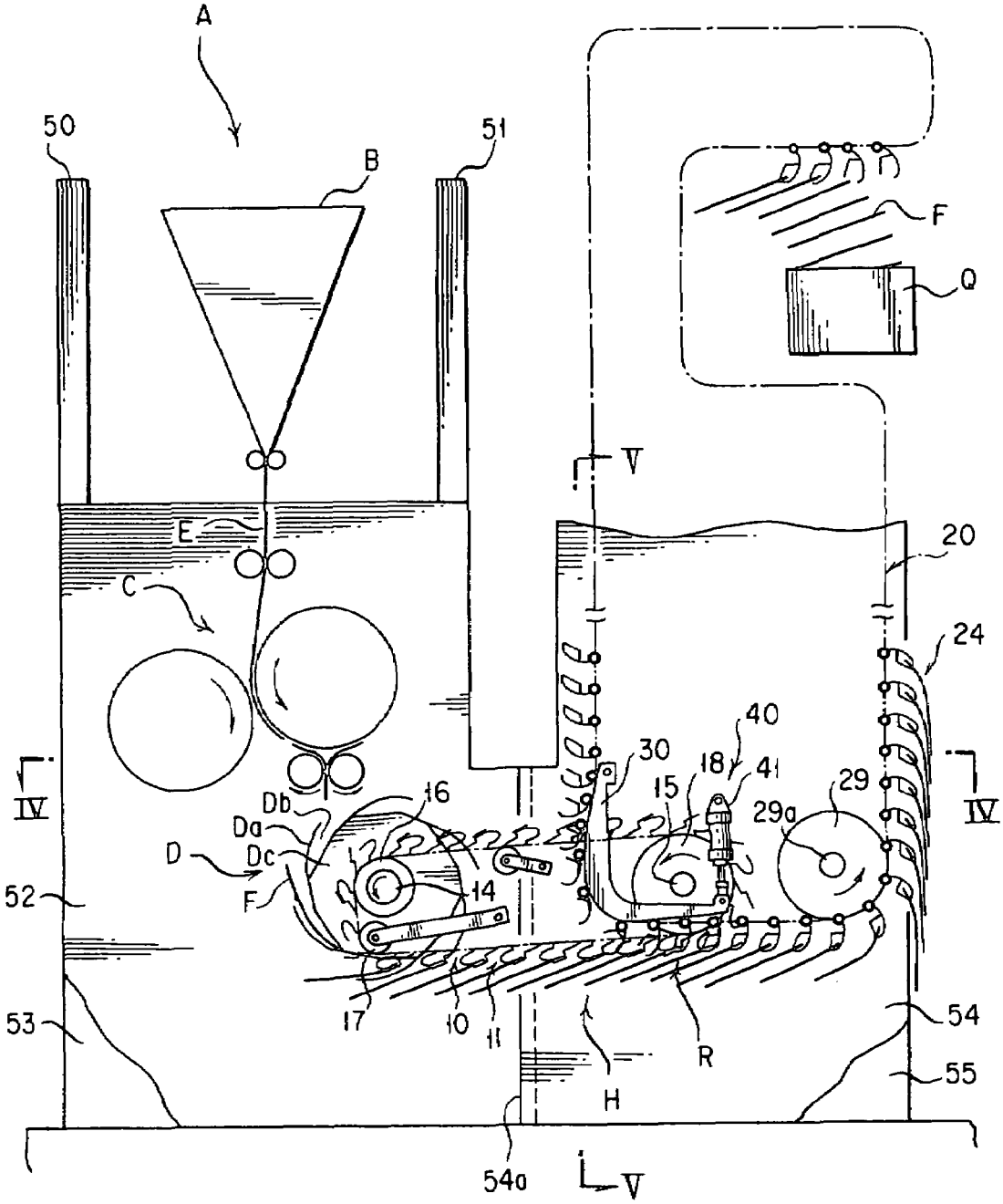
FIG. 1 is a diagrammatic side elevation of the conveyor system according to the invention as adapted for use with a web-fed printing press for transporting the completed signatures from the delivery fan to the stacking station.

The conveyor system according to the invention is believed to be best applied to the rotary printing press for transportation of signatures from the web folding and cutting station, from which the signatures emerge completed, to the stacking station where the signatures are stacked one upon another. FIG. 1 shows the folding and cutting station at A, the stacking station at Q, and the conveyor system at H.

Figure 2:
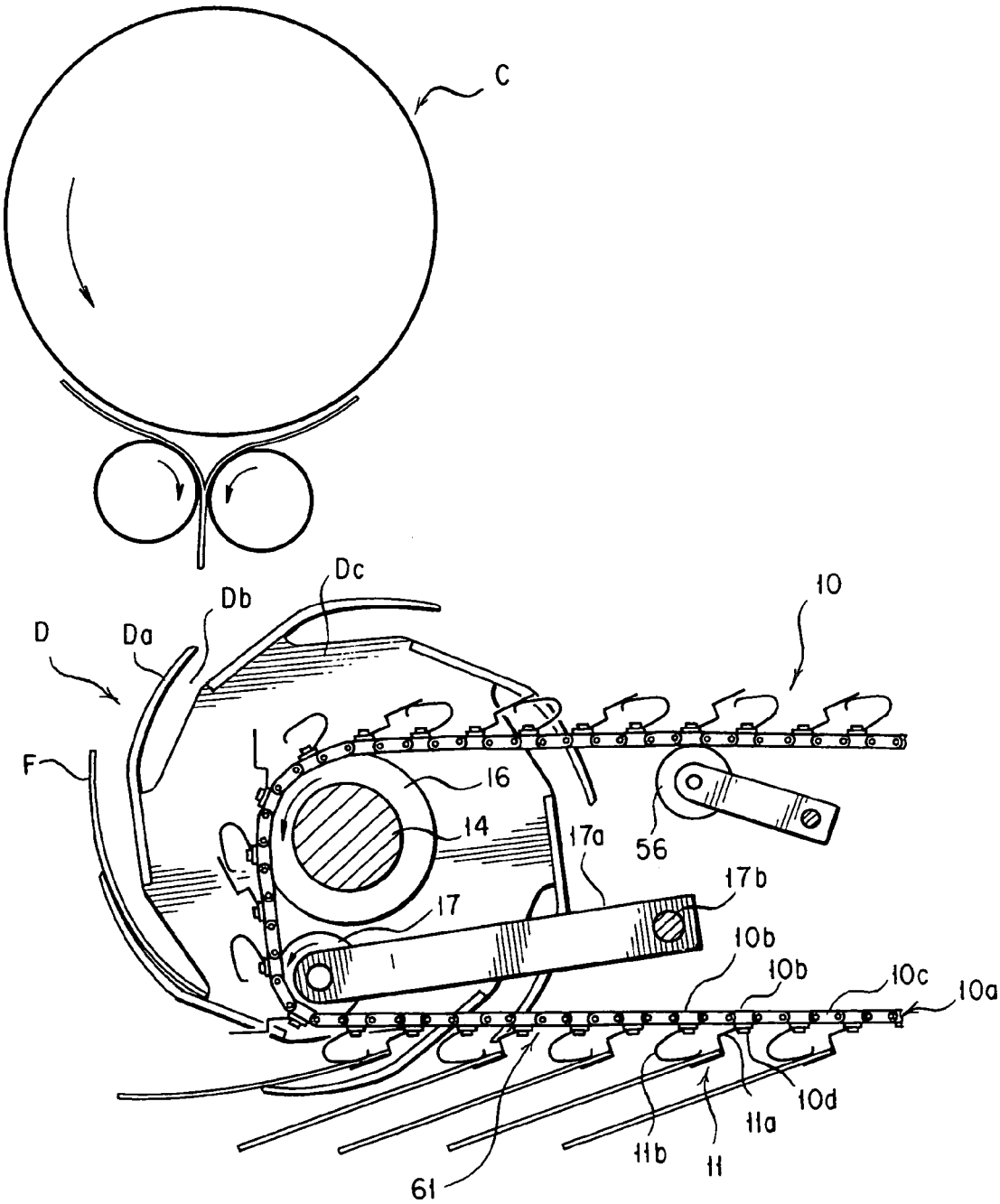
FIG. 2 is an enlarged, fragmentary side elevation view showing part of the first conveyor of the conveyor system together with the delivery fan and the cutting and folding cylinders.

As shown also in FIG. 1 and partly in FIG. 2, the folding and cutting station A has a former B, a set of cutting and folding cylinders C, and a delivery fan D, all of conventional make. The former B is mounted between a pair of confronting framing walls 50 and 51, and the cylinders C and delivery fan D between another pair of confronting framing walls 52 and 53 which are laid at right angles with the walls 50 and 51. The printed web E is longitudinally folded over itself by the former B and transversely cut into sections and folded again by the cylinders C.

Figure 4:
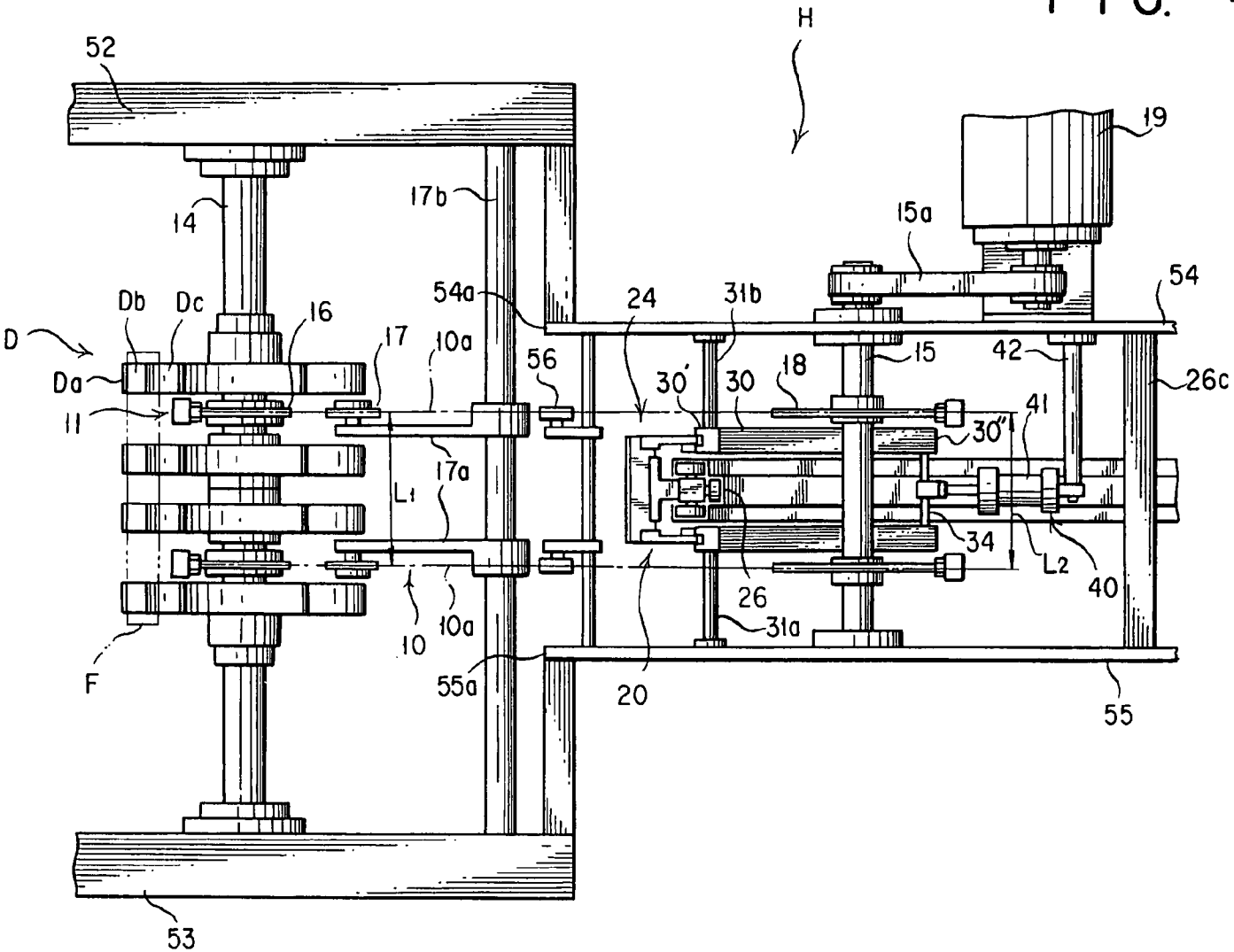
FIG. 4 is a developed, horizontal sectional view taken along the line IV—IV in FIG. 1.

As depicted in a plan view in FIG. 4, the delivery fan D has a plurality of, four shown, hubs $D_c$ nonrotatably mounted on a shaft 14 rotatably supported by and between the pair of framing walls 52 and 53. The shaft 14, and therefore the delivery fan D, rotate in timed relation to the cutting and folding cylinders C. Each hub $D_c$ has a series of vanes $D_a$ arranged at constant circumferential spacings thereon. Extending approximately tangentially of the hubs $D_c$, the vanes $D_a$ on all the hubs are aligned axially of the fan to define pockets $D_b$ in combination with the hubs. The folded sections, or signatures F, are deposited one by one into the pockets $D_b$.

Figure 3:
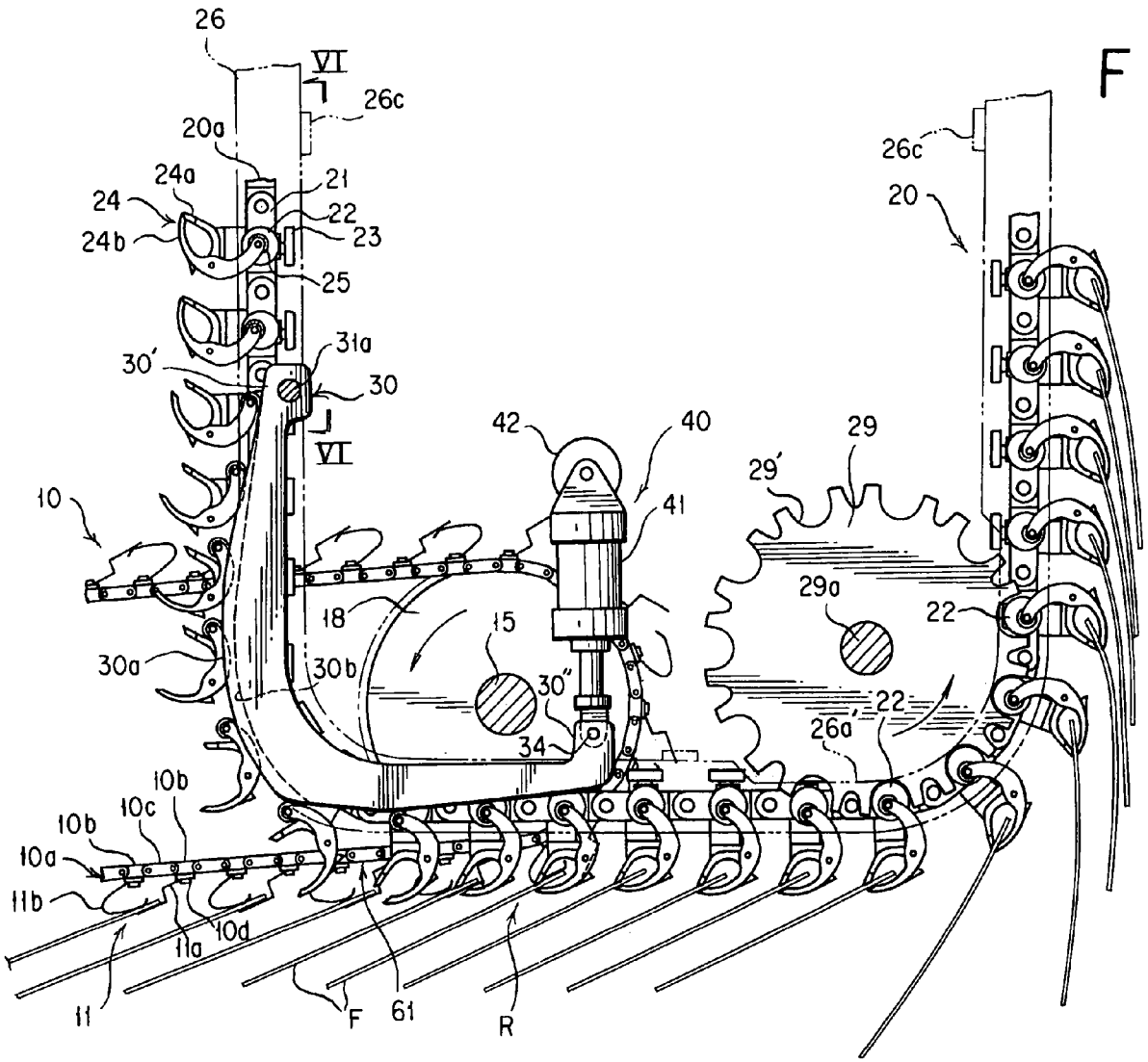
FIG. 3 is a fragmentary side elevational view showing the other part of the first conveyor together with part of the second conveyor and the transfer control cams, the transfer control cams being shown in the loading position to permit transfer of the signatures from the first to the second conveyor.

The conveyor system H according to the invention comprises a first conveyor 10 for transporting the signatures F from the delivery fan D to a transfer position R, FIGS. 1 and 3, and a second conveyor 20 for transporting the signatures from the transfer position R to the stacking station Q. The first conveyor 10 has two series of first grippers 11 mounted thereto for gripping the signatures F being carried by the delivery fan D and for releasing them in the transfer position R. The second conveyor 20 has a single row of second grippers 24, FIG. 3, for gripping the signatures F shortly before they are released from the first grippers 11 on the first conveyor 10 in the transfer position, and for releasing the signatures at the stacking station Q. A transfer control mechanism including a pair of transfer control cams 30 is provided at 40, FIGS. 1, 3 and 4, for permitting or blocking the transfer of the signatures from the first to the second conveyor.

The noted first conveyor 10, first grippers 11, second conveyor 20, second grippers 24, and transfer control mechanism 40 will be discussed in more detail hereinbelow, in that order and under separate headings. Operational description will follow the discussion of the listed components.

First Conveyor

Reference may be had to FIGS. 1–4 for a study of the first conveyor 10. The first conveyor 10 is constituted of two endless roller chains $10_a$ extending respectively around a pair of idler sprocket wheels 16, another pair of idler sprocket wheels 17, and a pair of drive sprocket wheels 18. As best seen in FIG. 4, the first pair of idler sprocket wheels 16 are mounted on the shaft 14 via antifriction bearings for independent rotation relative to the shaft. The idler sprocket wheels 16 are disposed just inwardly of the two outmost ones of the four delivery fan hubs $D_c$ on the shaft 14.

The second pair of idler sprocket wheels 17 are rotatably supported on the distal ends of arms $\mathbf{17}_a$ which are proximally cantilevered to a crossbeam $\mathbf{17}_b$, FIG. 4, extending between the pair of framing walls 52 and 53. The second pair of idler sprocket wheels 17 are in axial alignment with each other and rotate in planes containing the first pair of idler sprocket wheels 16.

The pair of drive sprocket wheels 18 are both mounted fast to a drive shaft 15 extending between, and rotatably supported by, an additional pair of confronting framing walls 54 and 55 which are laid parallel to the second mentioned pair of framing walls 52 and 53. Erected side by side with the second pair of framing walls 52 and 53, the third pair of framing walls 54 and 55 have edges $\mathbf{54}_a$ and $\mathbf{55}_a$ received between, and rigidly joined to, the framing walls 52 and 53. The drive shaft 15 has one end projecting outwardly of the framing wall 54 and coupled to a first conveyor drive motor 19 via a timing belt $\mathbf{15}_a$. As is well known, the timing belt $\mathbf{15}_a$ has cogs molded thereon to fit into grooves in the pulleys on the drive shaft 15 and on the motor output shaft. The first conveyor drive motor 19 operates under the direction of control electronics, not shown, for driving the first conveyor 10 independently of the second conveyor 20 and other working parts of the press.

According to a feature of this invention, the spacing $L_1$, FIG. 4, between the second pair of idler sprocket wheels 17, and therefore between the first pair of idler sprocket wheels 16, is somewhat less than the spacing $L_2$ between the pair of drive sprocket wheels 18. Thus the pair of endless chains $\mathbf{10}_a$ of the first conveyor 10 diverge apart as they run from the second pair of idler sprocket wheels 17 to the pair of drive sprocket wheels 18. The difference between these spacings $L_1$ and $L_2$ should be such that it does not adversely affect the smooth travel of the conveyor chains $\mathbf{10}_a$ over the three pairs of sprocket wheels 16–18. As required, an additional pair of idler sprocket wheels may be provided as at 56 in FIGS. 2 and 4 in order to prevent upper flights of the conveyor chains $\mathbf{10}_a$ from sagging between the sprocket wheel pairs 16 and 18.

First Grippers

As indicated in both FIGS. 2 and 3, the two endless chain $\mathbf{10}_a$ of the first conveyor 10 are each constituted of an alternating and lapping row of inside links $\mathbf{10}_b$ and outside links $\mathbf{10}_c$. The inside links $\mathbf{10}_b$ are all flanged at $\mathbf{10}_d$ for alternately carrying first grip fingers $\mathbf{11}_a$ and second grip fingers $\mathbf{11}_b$. Each first grip finger $\mathbf{11}_a$ and one second grip finger $\mathbf{11}_b$ on its upstream side with respect to the traveling direction of the first conveyor 10 constitute in combination one of the first grippers 11. All such grip fingers $\mathbf{11}_a$ and $11_b$ on both endless chains $\mathbf{10}_a$ of the first conveyor 10 are in transverse alignment, and each transversely aligned pair of grip fingers conjointly grip a signature at two spaced points on one edge thereof, as will become more apparent as the description proceeds.

The grip fingers $\mathbf{11}_a$ and $\mathbf{11}_b$ are both fabricated from strips of resilient material such as steel, with a width determined not to interfere with the vanes $D_a$ or hubs $D_c$ of the delivery fan D. The first grip fingers $\mathbf{11}_a$ are each approximately in the shape of a Z and generally angled upstream of the first conveyor 10. The second grip fingers $\mathbf{11}_b$ are each approximately U shaped and has its free limb angled downstream of the first conveyor 10. Each first grip finger $\mathbf{11}_a$ and one second grip finger $\mathbf{11}_b$ on its upstream side, constituting in combination one gripper 11 as above, are movable into and out of gripping engagement with each other with the travel of the endless chain $\mathbf{10}_a$ over the sprocket wheels 16–18.

More specifically, as will be understood from a closer study of FIG. 2, the first grip fingers $\mathbf{11}_a$ turn away from the associated second grip fingers $\mathbf{11}_b$ as their chain links $\mathbf{10}_b$ ride over the sprocket wheels 16–18, and back into gripping engagement with the second grip fingers $\mathbf{11}_b$ as the chain links $\mathbf{10}_b$ ride off the sprocket wheels into the following straight stretches of the first conveyor 10. Thus the grippers 11 open while traveling over the sprocket wheels 16–18 and close on the straight stretches of the first conveyor 10.

The two endless chains $\mathbf{10}_a$ of the first conveyor 10 are so positioned with respect to the delivery fan D that each transversely aligned pair of grippers 11 on the endless chains will grip one signature F at the loading end of the first conveyor adjacent the delivery fan, as the pair of grippers open and close while riding over and off the sprocket wheel 17. The pair of grippers 11 will be held closed, holding the signature F, while traveling along the following lower flight of the first conveyor 10. At the transfer station R, on the other hand, where the first conveyor 10 interdigitate with the second conveyor 20, the pair of grippers 11 will release the signature and hand over to the second conveyor as they open by riding onto the sprocket wheel 18.

It is understood that the running speed of the first conveyor 10 is less than the peripheral speed of rotation of the delivery fan D. Therefore, while each pair of grippers 11 are traveling open over the sprocket wheel 17 as in FIG. 2, the delivery fan D will insert one signature F between the two transversely aligned pairs of grip fingers $\mathbf{11}_a$ and $\mathbf{11}_b$. These grip fingers will then turn toward each other, gripping the signature F, as they ride off the sprocket wheel 17. Then the signature F will slide down and off the delivery fan vane $D_a$ with the continued rotation of the delivery fan and so be completely loaded on the first conveyor 10.

Second Conveyor

Figure 5:
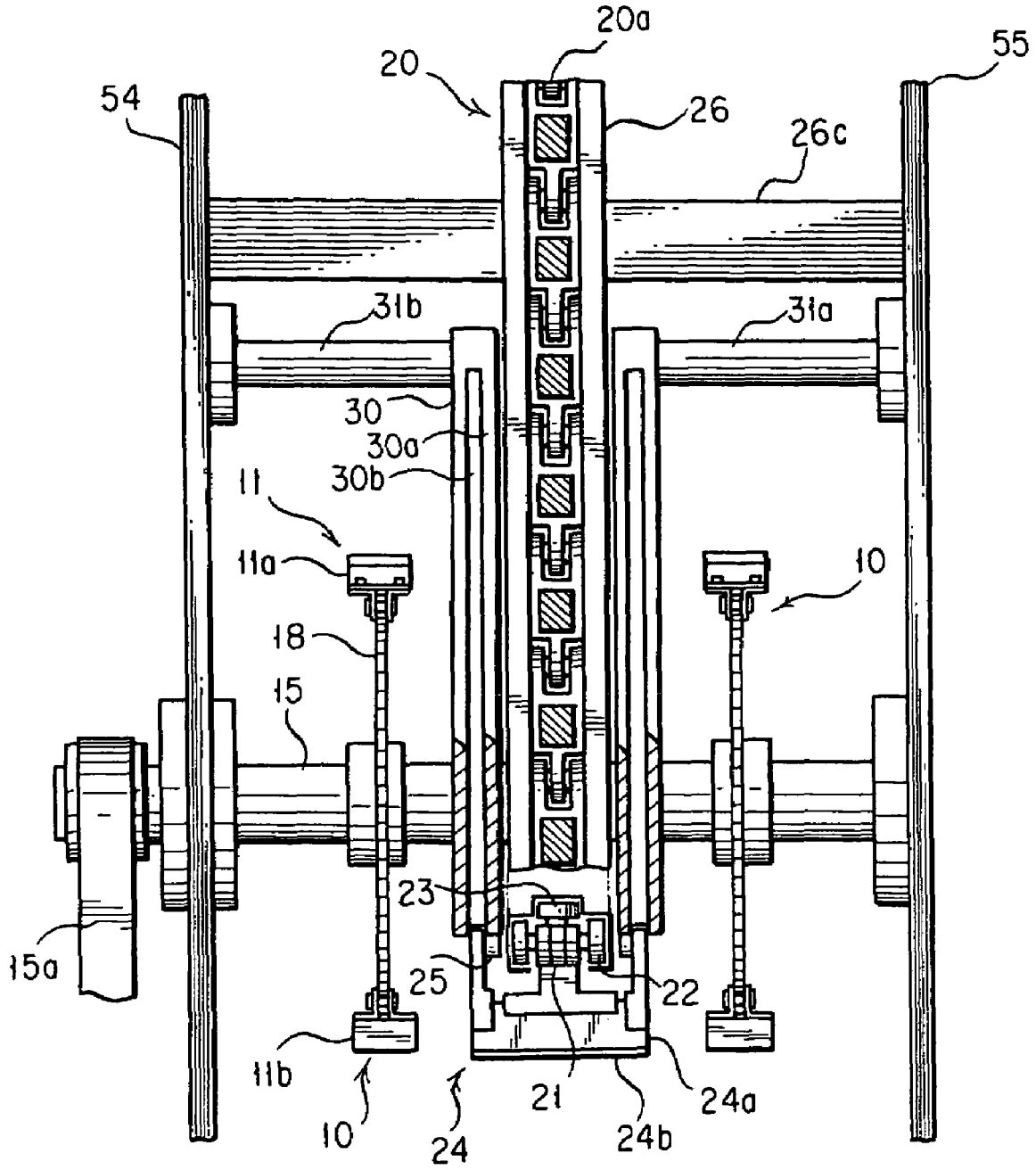
FIG. 5 is an enlarged, vertical sectional view of the conveyor system taken along the line V—V in FIG. 1.

With reference to FIGS. 1, 3–5 the second conveyor 20 is constituted of a single endless roller chain $\mathbf{20}_a$ having the second grippers 24 on its links 21. The endless chain $\mathbf{20}_a$ is wheeled, as will be detailed later, to roll along a guide rail 26 supported by crossbeams $\mathbf{26}_c$ between the pair of framing walls 54 and 55. FIGS. 4 and 5 indicate that the guide rail 26 is contained in one vertical plane between the two endless chains $\mathbf{10}_a$ of the first conveyor 10 running around the sprocket wheels 16–18. It will also be observed from FIG. 3 that the guide rail 26 turns approximately right-angularly at or adjacent the transfer position R.

Figure 6:
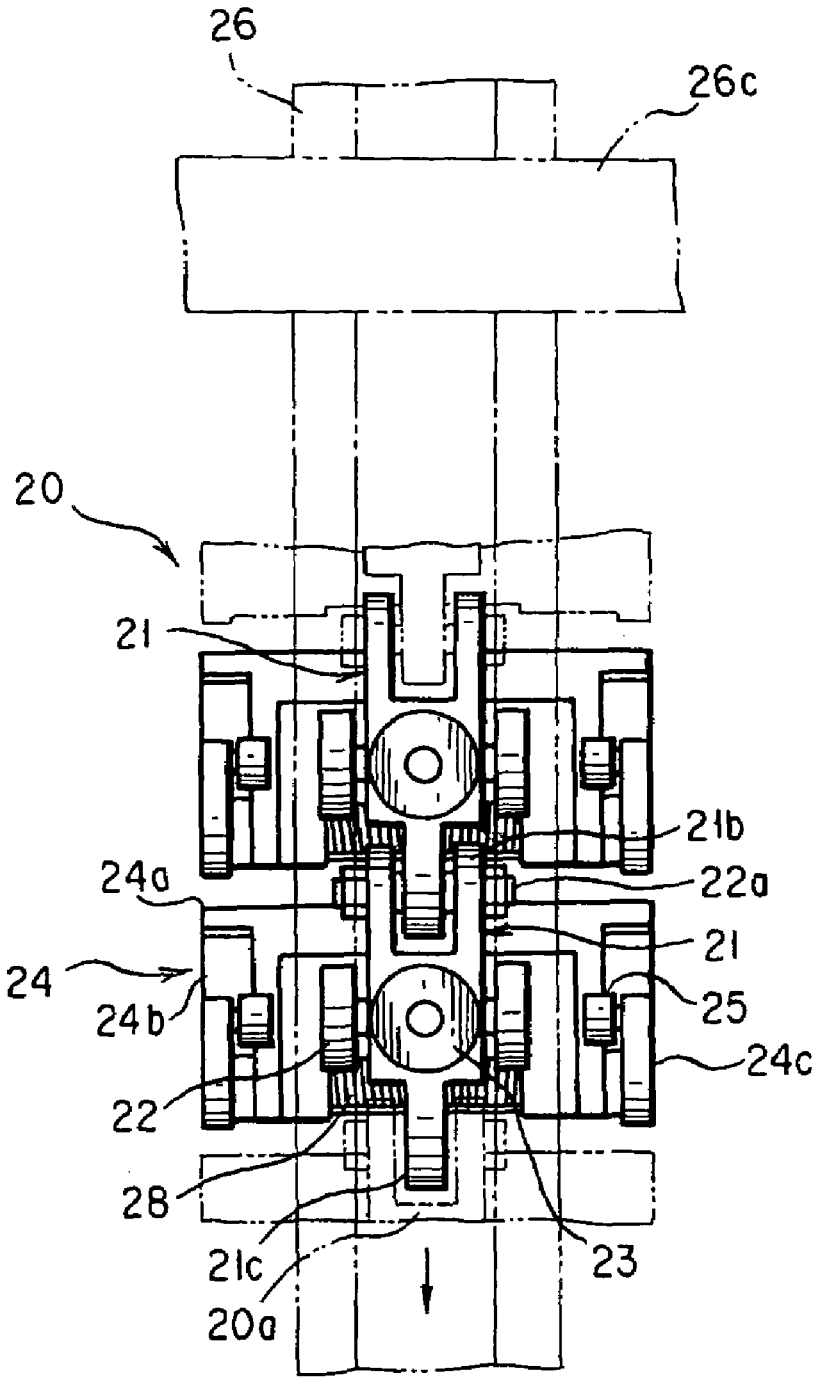
FIG. 6 is a still more enlarged view of the second conveyor as seen in the direction of the arrows VI in FIG. 3.
Figure 7:
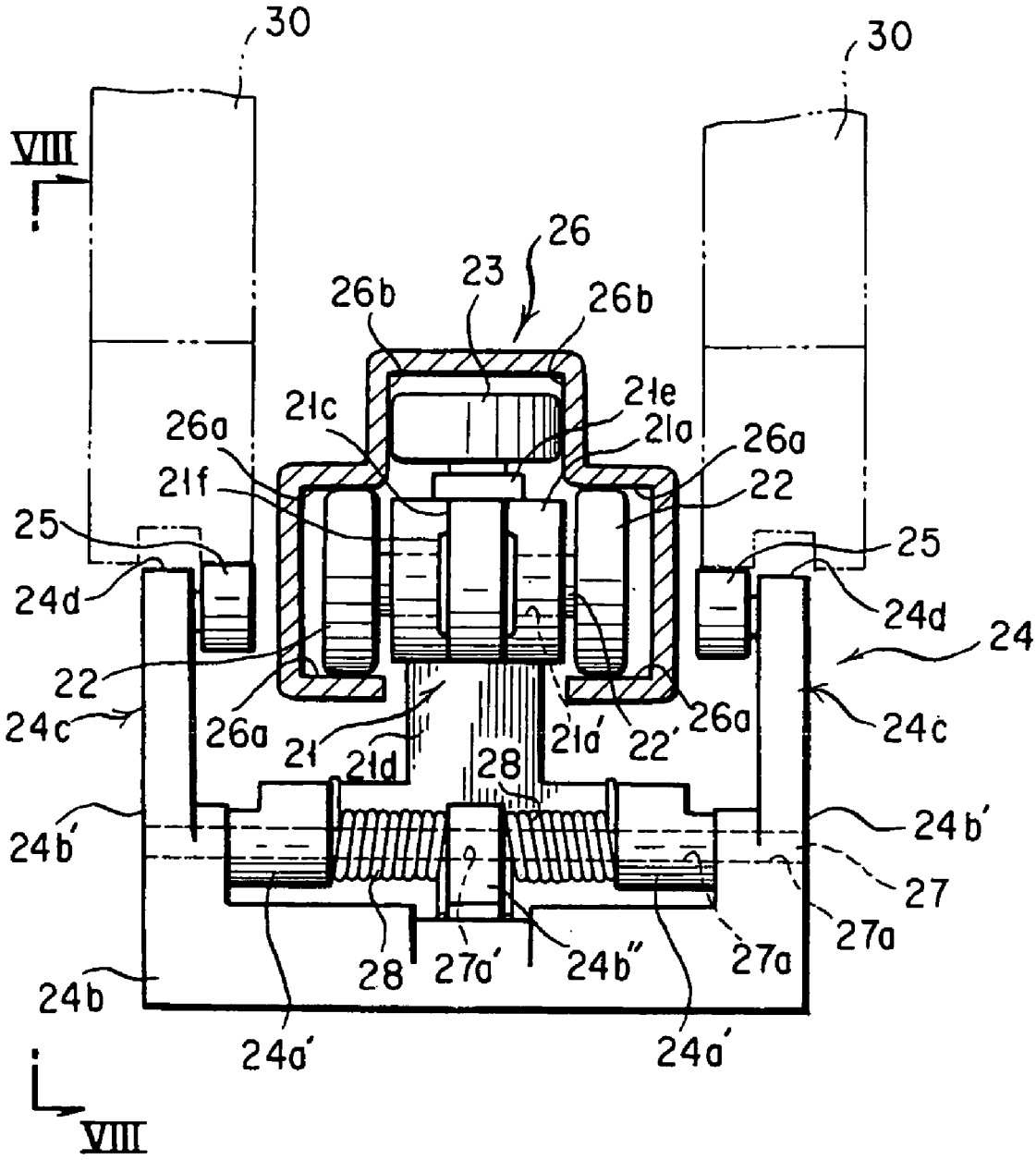
FIG. 7 is an even more enlarged, cross sectional view of the second conveyor taken along the line VII—VII in FIG. 8.
Figure 8:
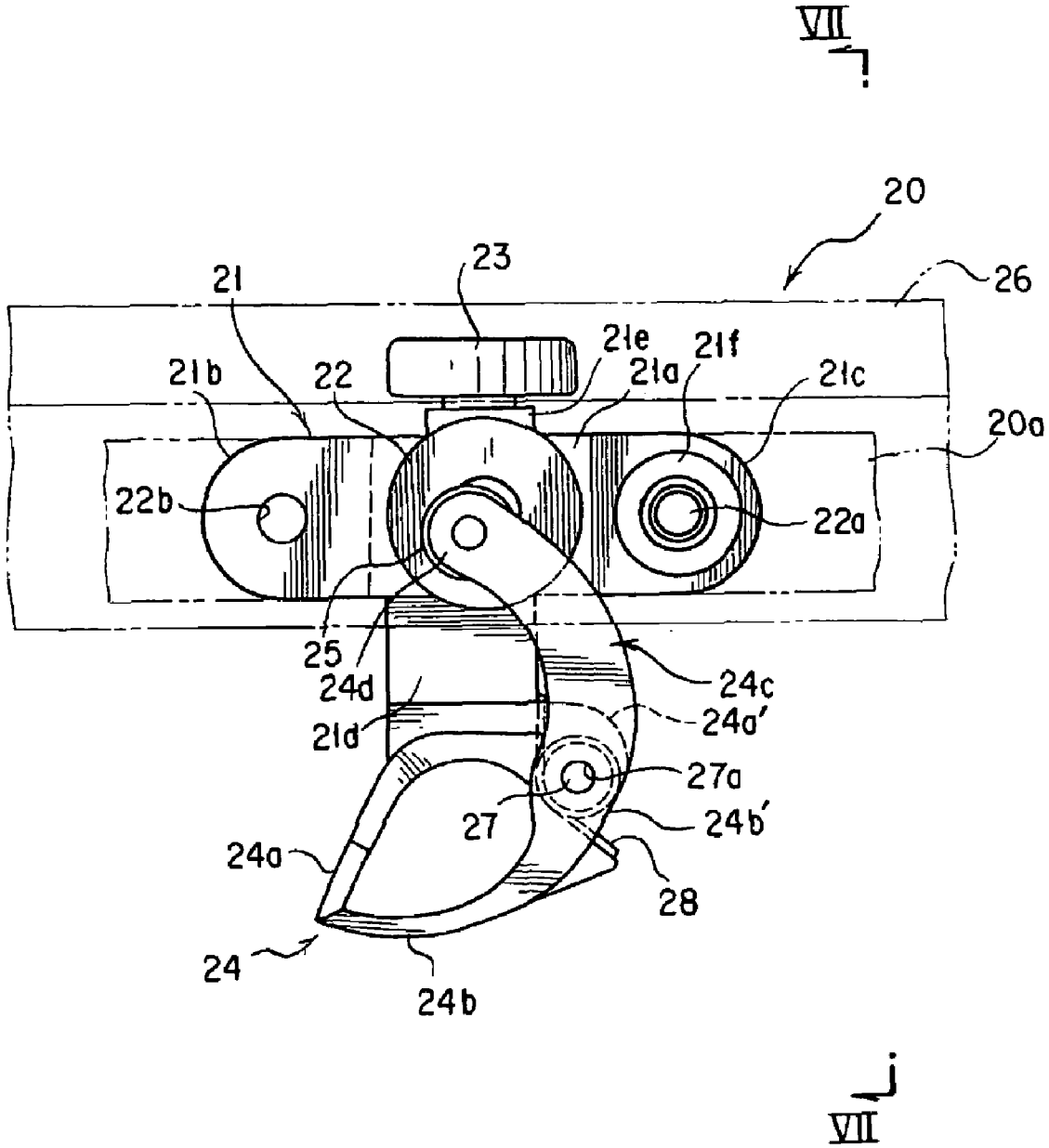
FIG. 8 is a fragmentary side elevational view of the second conveyor as seen in the direction of the arrows VIII in FIG. 7.

FIGS. 6, 7 and 8 are enlarged, more detailed illustrations of the wheeled links 21 of the endless chain $\mathbf{20}_a$ constituting the second conveyor 20. Each link 21 has a body part $\mathbf{21}_a$ of boxlike shape elongated in the traveling direction of the chain $\mathbf{20}_a$, terminating at its opposite ends in a groove end $\mathbf{21}_b$ and a tongue end $\mathbf{21}_c$. The groove end $\mathbf{21}_b$ has a hole $\mathbf{22}_b$ cut transversely therethrough. The tongue end $\mathbf{21}_c$ is also bored transversely and has a spherical bearing $\mathbf{21}_f$ mounted therein. The groove end $\mathbf{21}_b$ of each link 21 receives the tongue end $\mathbf{21}_c$ of the neighboring link 21. The endless chain $\mathbf{20}_a$ is formed as all the links 21 are joined together by connecting pins $\mathbf{22}_a$ which are inserted in and through the holes $\mathbf{22}_b$ in the groove ends $\mathbf{21}_b$ of the links and the holes in the spherical bearings $\mathbf{21}_f$ on the tongue ends $\mathbf{21}_c$ of the links.

As seen in FIG. 7, the body part $\mathbf{21}_a$ of each link 21 has another hole $\mathbf{21}_a$' extending transversely therethrough to receive an axle 22'. This axle 22 rotatably carries on its opposite ends a pair of wheels 22 for rolling engagement with the guide rail. Another wheel 23 is supported by a boss $\mathbf{21}_e$ on the body part $\mathbf{21}_a$ of each link 21 for rotation relative to the link about an axis at right angles with the axis of rotation of the wheel pair 22.

Cross-sectionally shaped as best pictured in FIG. 7, the guide rail 26 accommodates the complete links 21 of the second conveyor 20. Further the guide rail 26 has a pair of opposed grooves $\mathbf{26}_a$ for rotatably receiving the pair of wheels 22 on each link 21, and another groove $\mathbf{26}_b$ for rotatably receiving the other wheel 23. Thus the second conveyor 20 is positively guided for transporting the successive signatures F from transfer position R to stacking station Q.

At 29 in FIG. 3 is seen a sprocket wheel mounted on a second conveyor drive shaft $\mathbf{29}_a$ for driving the endless chain $\mathbf{20}_a$ of the second conveyor 20 along the guide rail 26. It is understood that the second conveyor drive shaft $\mathbf{29}_a$ can be set into and out of rotation independently of the first conveyor drive motor 19, FIG. 4. The sprocket wheel 29 has a series of concavities 29' cut in its circumference at constant angular spacings for positive engagement with the pairs of wheels 22 on the second conveyor chain links 21. The guide rail 26 is recessed longitudinally at $\mathbf{26}_a$', FIG. 3, to expose the pairs of wheels 22 for positive engagement with the sprocket wheel 29. As indicated by the arrow in FIG. 3, the sprocket wheel 29 rotates counterclockwise to drive the endless chain $\mathbf{20}_a$ along the guide rail 26.

Second Grippers

As best shown in FIGS. 7 and 8, each chain link 21 of the second conveyor 20 carries one second gripper 24. Each link has a gripper carrier $\mathbf{21}_d$ formed thereon so as to project outwardly of the guide rail 26, for carrying the second gripper 24. Sturdier in construction than the first grippers 11 of the first conveyor 10, each second gripper 24 is comprised of what may be more aptly termed a fixed grip jaw $\mathbf{24}_a$ and a movable grip jaw $\mathbf{24}_b$. The fixed grip jaw $\mathbf{24}_a$ extends in both directions form the distal end of the gripper carrier $\mathbf{21}_d$ transversely of the second conveyor 20, projecting beyond both sides of the guide rail 26 as seen in FIG. 7. Cross-sectionally, the fixed grip jaw $\mathbf{24}_a$ is shaped as portrayed in FIG. 8 for gripping an edge of the signature F in combination with the movable grip jaw $\mathbf{24}_b$.

The gripper carrier $\mathbf{21}_d$ has a pair of sleeve bearings $\mathbf{24}_a$' formed on its side away from the gripping end of the fixed grip jaw $\mathbf{24}_a$. Axially aligned and spaced from each other, the pair of sleeve bearings $\mathbf{24}_a$' rotatably receive a pivot pin 27 having its opposite ends coupled to a pair of lugs $\mathbf{24}_b$' formed in one piece with the movable grip jaw $\mathbf{24}_b$. The movable grip jaw $\mathbf{24}_b$ extends transversely of the second conveyor 20 and has the same dimension in that direction as the fixed grip jaw $\mathbf{24}_a$. The movable grip jaw $\mathbf{24}_b$ is cross-sectionally curved as in FIG. 8 for firmly gripping a signature in coaction with the fixed grip jaw $\mathbf{24}_a$.

A pair of arms $\mathbf{24}_c$ of each second gripper 24 extend from the lugs $\mathbf{24}_b$' in a direction away from the movable grip jaw $\mathbf{24}_b$, each forming a curve that is approximately concentric with the cross sectional curve of the movable grip jaw. The each pair of arms $\mathbf{24}_c$ carry on their distal ends $\mathbf{24}_d$ a pair of cam follower rolls 25 which are rotatable relative to the arms $\mathbf{24}_c$ about a common axis extending transversely of the guide rail 26. With the travel of the second conveyor 20 the pair of cam follower rolls 25 are to ride over the pair of transfer control cams 30, FIGS. 1, 3 and 4, thereby to cause the movable grip jaw $\mathbf{24}_b$ to turn into and out of gripping engagement with the fixed grip jaw $\mathbf{24}_a$.

At $\mathbf{24}_b$" in FIG. 7 is seen a lug formed on the movable grip jaw $\mathbf{24}_b$ of each second gripper 24 in the middle of its longitudinal dimension. The lug $\mathbf{24}_b$" has a hole $\mathbf{27}_a$' formed therethrough to receive the pivot pin 27. Coiled upon the pivot pin 27, a pair of torsion springs 28 acts between fixed grip jaw $\mathbf{24}_a$ and movable grip jaw $\mathbf{24}_b$ to bias the latter into gripping engagement with the former. The second grippers 24 are thus normally held closed as in FIG. 8.

Transfer Control Mechanism

Figure 9:
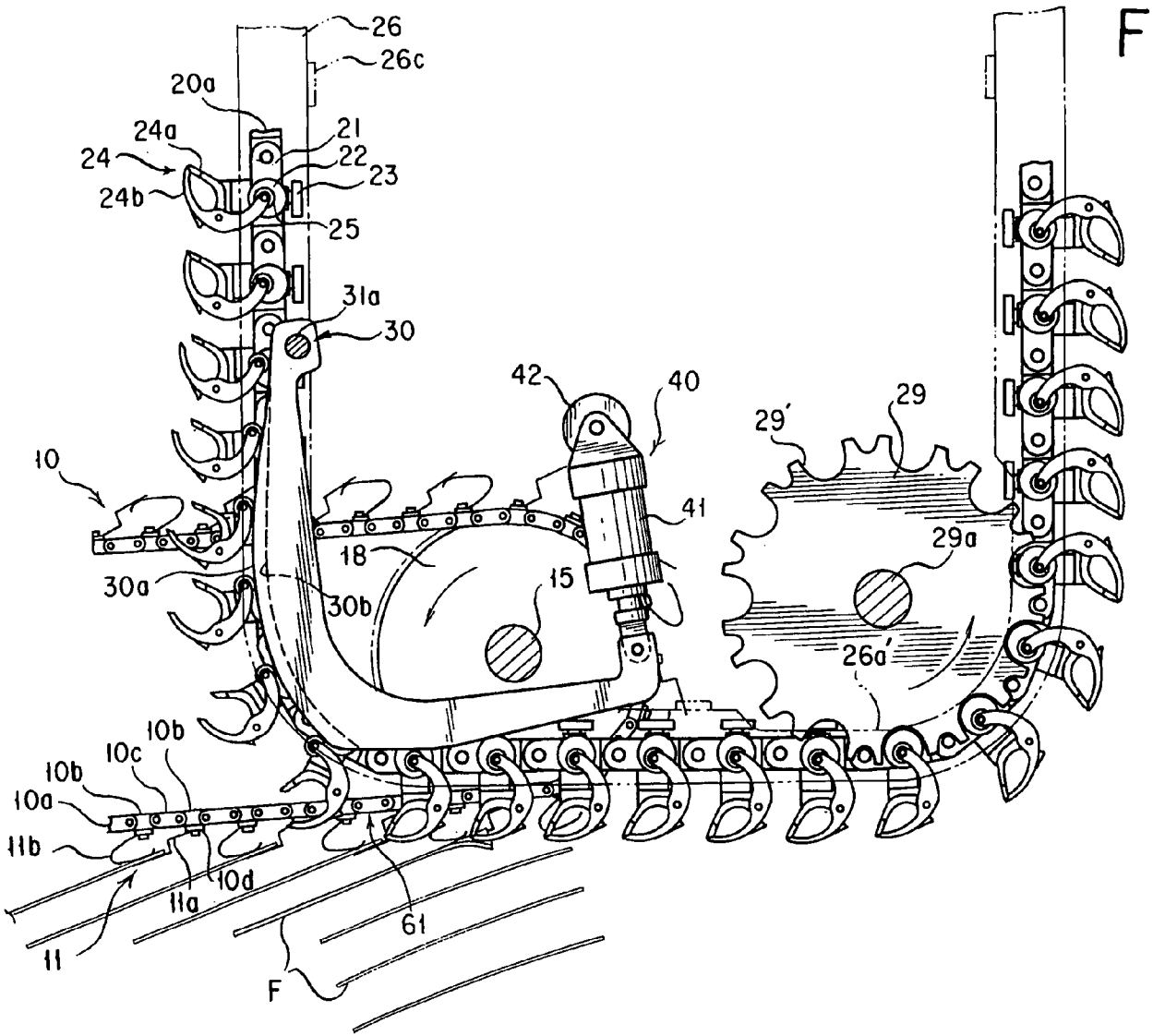
FIG. 9 is a view similar to FIG. 3 except that the transfer control cams are shown in the nonloading position, blocking the transfer of the signatures from the first to the second conveyor.

The construction and operation of the transfer control mechanism 40 including the pair of transfer control cams 30 will become apparent from an inspection of FIGS. 3, 4 and 9. The pair of transfer control cams 30 are disposed on both sides of the guide rail 26 and each approximately L shaped as seen in a side view as in FIGS. 3 and 9, extending along the corner of the guide rail immediately upstream of the signature transfer position R.

The upstream ends 30', with respect to the traveling direction of the second conveyor 20, of the transfer control cams 30 are cantilevered at $\mathbf{31}_a$ and $31_b$ to the pair of framing walls 54 and 55 for pivotal motion in planes parallel to the plane of the second conveyor. The downstream ends 30" of the transfer control cams 30 are rigidly interconnected by a cross pin 34 to which is coupled a fluid-actuated cylinder 41 yet to be described. Driven by this cylinder, the transfer control cams 30 are to turn between the loading position of FIG. 3 and the nonloading position of FIG. 9. The loading position is so named because the transfer control cams 30 when in this position permit the second conveyor 20 to be loaded with the signatures in the transfer position R. The nonloading position is such that the second conveyor 20 is not loaded with the signatures in the transfer position R.

The transfer control cams 30 have contoured cam surfaces $\mathbf{30}_a$ over which are to roll the pair of cam follower rolls 25 on the movable grip jaws $\mathbf{24}_b$ of the second grippers 24 on the second conveyor 20. The transfer control cams 30 are grooved longitudinally at $\mathbf{30}_b$ in order to avoid interference with the arched arms $\mathbf{24}_c$, FIG. 8, carrying the cam follower rolls 25.

As shown in both FIGS. 3 and 4, the fluid-actuated cylinder 41 has its rod end coupled pivotally to the cross pin 34 between the pair of transfer control cams 30, and its head end to a cantilever 42 on the framing wall 54. It is understood that the cylinder 41 is placed as by a solenoid valve, not shown, in and out of communication with a source of fluid under pressure, also not shown. The cylinder 41 is shown extended in FIG. 3, holding the transfer control cams 30 in the loading position, and contracted in FIG. 9, holding the transfer control cams in the nonloading position. The following is a discussion of the behaviors of the second grippers 24 on the second conveyor 20 when the transfer control cams 30 is in the loading position and the nonloading position.

First, when the transfer controls cams 30 are in the loading position, the movable grip jaws $\mathbf{24}_b$ of the second grippers 24 will swing away from the fixed grip jaws $\mathbf{24}_a$ against the bias of the torsion springs 28, FIG. 7, as the pair of cam follower rolls 25 on each movable grip jaw ride onto the transfer control cams. Then the open second grippers 24 will start traveling side by side with the first grippers 11 on the first conveyor 10 carrying the signatures F. Since the first conveyor 10 runs faster than the second 20 as aforesaid, each signature F being carried by one transversely aligned pair of first grippers 11 on the first conveyor 10 will be inserted in one of the second grippers 24 on the second conveyor 20.

As will be noted from FIG. 3, the second grippers 24 on the second conveyor 20 will start closing almost immediately after they turn around the corner of the transfer control cams 30 and come to the straight stretch 61 of the guide path. The second grippers 24 will be completely closed in the transfer position R, where the cam follower rolls 25 ride off the transfer control cams 30, thereby holding the signatures under the forces of the torsion springs 28.

Also, approximately in the transfer position R, the successive pairs of first grippers 11 on the first conveyor 10 will start riding onto the drive sprockets 18 and so start opening. Thus the first grippers 11 will release the signatures approximately concurrently with the gripping thereof by the second gripper 24, so that the signatures will be smoothly transferred from the first conveyor 10 to the second 20 in the transfer position R when the transfer control cams 30 are in the loading position as in FIG. 3.

When the transfer control cams 30 are in the nonloading position as in FIG. 9, on the other hand, the second grippers 24 on the second conveyor 20 will also open, though to a less extent than when the transfer control cams are in the loading position, as the cam follower rolls 25 ride onto the transfer control cams. However, the cam follower rolls 25 will ride off the transfer control cams 30 immediately after they turn around the corner of the transfer control cams 30 and come to the straight stretch of the guide path. The second grippers 24 will be held closed as they travel side by side with the first grippers 11 on the first conveyor 10. The signatures F being carried by the faster-running first conveyor will slide over the curved undersides of the second grippers 24. No transfer of the signatures will occur from the first conveyor 10 to the second 20 in the transfer position; instead, the signatures will fall off the first conveyor as the first grippers 11 open by riding onto the drive sprockets 18.

Operation

Issuing from the cutting and folding cylinders C, the signatures F will be received in the successive pockets $D_b$ of the delivery fan D which is in counterclockwise rotation as viewed in FIGS. 1 and 2. Each signature F will be conveyed by the delivery fan D approximately a quarter of a revolution before being inserted into one transversely aligned pair of first grippers 11 on the slower-running first conveyor 10, as the grip fingers $\mathbf{11}_a$ and $\mathbf{11}_b$ of these first grippers open by riding over the sprocket wheels 17.

The successive first grippers 11 will be closed as they come to the lower stretch of the first conveyor 10, with the result that each signature is gripped by one transversely aligned pair of first grippers at two spaced points on one edge thereof. The gripped signatures will slide down the vanes $D_a$ of the delivery fan D as the latter runs faster than the first conveyor 10, and thereafter be carried by the first conveyor away from the delivery fan toward the transfer position R.

It is now assumed that the fluid actuated cylinder 41 has been held extended as in FIG. 3, holding the pair of transfer control cams 30 in the loading position as in the same figure. The second grippers 24 on the second conveyor 20 will open before arriving at the transfer position R, as the pairs of cam follower rolls 25 ride over the respective transfer control cams 30 thereby causing the associated movable grip jaws $\mathbf{24}_b$ to swing away from the fixed grip jaws $\mathbf{24}_a$. The second grippers 24 start closing as they come to the lower stretch 61 of the second conveyor 20 and begins traveling between the two rows of first grippers 11 on the first conveyor 10 in approximately coplanar relationship thereto on the upstream side of the transfer position R. Since the first conveyor 10 is running faster than the second conveyor 20, each signature being carried by one pair of first grippers 11 on the first conveyor will be inserted between the open grip jaws $\mathbf{24}_a$ and $\mathbf{24}_b$ of one second gripper 24 on the second conveyor.

Then, in the transfer position R, the second grippers 24 will close as the cam follower rolls 25 ride off the transfer control cams 30. Each second gripper 24 will then grip the signature at one point on its edge between the points thereon where it has been gripped by one transversely aligned pair of first grippers 11 on the first conveyor 10. Concurrently, the first gripers 11 will open, releasing the signature, as the roller chains $\mathbf{10}_a$ of the first conveyor ride onto the drive sprockets 18. Now has been completed the transfer of the signature from the first conveyor 10 to the second 20.

It will be recalled that, as indicated in FIG. 4, the axial spacing $L_1$ between the pair of idler sprocket wheels 17 is made less than the axial spacing $L_2$ between the pair of drive sprocket wheels 18. The sprocket wheels 17 lie immediately upstream of the sprocket wheels 18 with respect to the traveling direction of the endless chains $\mathbf{10}_a$, so that these chains diverge apart as they run from wheels 17 to wheels 18. As a result, even though each transversely aligned pair of first grippers 11 may receive the signature from the delivery fan D with some slack between them, that slack will be removed with the travel of the signature toward the transfer position R, as the pair of first grippers become wider apart while traveling along the divergent lengths of the endless chains $\mathbf{10}_a$. The signature will come to the transfer position with its edge fully stretched, to be firmly engaged by one of the second grippers 24 on the second conveyor 20. There will be no dangers of the signatures hitting the tips of the slower-running second grippers 24, being engaged incorrectly or wrinkled by the second grippers, or falling off the first and the second grippers.

Transferred as above from the first to the second conveyor, the signatures will be transported by the latter to the next processing station shown at Q in FIG. 1. By riding onto another pair of cams, not shown, the second grippers 24 will successively release the signatures at this processing station Q.

Faulty or incomplete signatures will unavoidably be produced at the start of each run of printing operation. It is desirable that such undesired signatures be discharged at an earlier stage than the processing station Q. Then the fluid-actuated cylinder 41 of the transfer control mechanism 40 may be contracted as in FIG. 9 by actuating the unshown solenoid valve through which the cylinder communicates with the unshown source of fluid under pressure. The pair of transfer control cams 30 will then swing from the loading position of FIG. 3 to the nonloading position of FIG. 9.

With the transfer control cams 30 thus turned to the nonloading position, the cam follower rolls 25 on the movable grip jaws $\mathbf{24}_b$ of the second grippers 24 on the second conveyor 20 will be out of contact with the surfaces $\mathbf{30}_a$ of the transfer control cams while traveling along the bottom stretch 61 of the guide path, thereby holding the second grippers closed. The signature being carried by each transversely pair of first grippers 11 on the first conveyor 10 will therefore slide over the underside of one associated second gripper 24 on the slower-running second conveyor 20. Then, in the transfer position R, the signature will fall off the pair of first grippers 11 without being captured by the second gripper 24, as the first grippers then open by riding onto the drive sprockets 18. The discharge of faulty signatures upstream of the processing station is desirable because they would cause trouble should they be allowed to travel further down the normal path.

While being transported as above by the first grippers 11 in forced engagement with the second grippers 24 on the slower-running second conveyor 20, the signatures may possibly be ruined by hitting or rubbing hard against the second grippers. This, however, will pose no problem at all because all such signatures are faulty and to be rejected.

The transfer control cams 30 may be turned from the nonloading position of FIG. 9 to the loading position of FIG. 3 by extending the cylinder 41 when the press starts production of normal signatures. All the following normal signatures will then be conveyed to the stacking station Q.

The usual practice in the printing industry is that the web of paper E, FIG. 1, is spliced from one roll to another when that one roll is used up. The transfer control cams 30 may be retracted to the nonloading position if the spliced joints between the successive lengths of web are to be rejected in the transfer position R.

The transfer control cams 30 may also be actuated to the nonloading position in event of some such trouble as the jam of the web occurs upstream of the first conveyor 10. The signatures produced after the occurrence of the trouble will then be not transferred from the first conveyor 10 to the second 20. As has been stated with reference to FIG. 4, the first conveyor 10 is driven by the drive motor 19 independently of the second conveyor 20. Therefore, even if the first conveyor 10 is then stopped to avoid discharge of additional signatures, the second conveyor 20 can be maintained in operation for transporting to the stacking station Q all the normal signatures that have already been transferred thereto. Only a minimal number of normal signatures will thus be held standing by on the delivery conveyor system pending the resumption of printing operation.

Various modifications and alterations of the above disclosed embodiment may be resorted to without departure from the subjoined claims.

What is claimed is:

1. A conveyor system for transportation of articles from a first to a second station, comprising:

(a) a first conveyor having a pair of endless chains each having a series of first grippers mounted thereto in transverse alignment with first grippers on the other endless chain, each transversely aligned pair of first grippers conjointly gripping an article at two spaced points on one edge thereof in a loading position adjacent the first station, and of releasing the article in a transfer position intermediate the first and the second station;

(b) a second conveyor having an endless chain having a series of second grippers mounted thereto, each second gripper gripping, in the transfer position, an article at a point on the edge thereof intermediate the two spaced points where the article has been gripped by one pair of first grippers on the first conveyor, and of releasing the article at the second station; and (c) means for driving the first and the second conveyor independently of each other.

2. A conveyor system as defined in claim 1, wherein the pair of endless chains of the first conveyor diverge apart as they extend from the loading to the transfer position.

3. A conveyor system as defined in claim 1, further comprising transfer control means capable of permitting or preventing the transfer of the articles from the first to the second conveyor.

4. A conveyor system as defined in claim 3, wherein the transfer control means comprises:

(a) transfer control cam means associated with the second grippers on the second conveyor and movable between a loading and a nonloading position for causing the second grippers to grip or not to grip the articles at the transfer position; and (b) actuator means coupled to the transfer control cam means for causing the same to move between the loading and the nonloading position.

5. A conveyor system as defined in claim 1, wherein, in the transfer position, a gripped portion of the article continuously moves in a rectilinear direction as a respective aligned pair of first grippers releases the article and a respective second gripper grips the article.

6. In a web-fed printing press, a conveyor system to be disposed downstream of a delivery fan for receiving signatures therefrom and transporting the same to the next processing station, the conveyor system comprising:

(a) a first conveyor having a pair of endless chains each having a series of pairs of grip fingers mounted thereto in transverse alignment with like pairs of grip fingers on the other endless chain, each transversely aligned pair of grip fingers being opened and closed in a loading position downstream of the delivery fan for conjointly gripping a signature at two spaced points on one edge thereof, and of releasing the signature in a transfer position intermediate the delivery fan and the next processing station;

(b) a second conveyor having an endless chain having a series of pairs of grip jaws mounted thereto, each pair of grip jaws being opened and closed in the transfer position for gripping the signature at a point on the edge thereof intermediate the two spaced points where the signature has been gripped by one transversely aligned pair of pairs of grip fingers on the first conveyor, and of releasing the signature at the next processing station; and (c) means for driving the first and the second conveyor independently of each other.

7. A conveyor system as defined in claim 6, wherein the pair of endless chains of the first conveyor diverge apart as they extend from the loading to the transfer position.

8. A conveyor system as defined in claim 6, further comprising transfer control means capable of permitting or preventing the transfer of the signatures from the first to the second conveyor.

9. A conveyor system as defined in claim 8, wherein the transfer control means comprises:

(a) transfer control cam means associated with the pairs of grip jaws on the second conveyor for causing the same to be opened and closed adjacent the transfer position, the transfer control cam means being movable between a loading position for permitting the second conveyor to be loaded with the signatures in the transfer position, and a nonloading position for preventing the second conveyor from being loaded with the signatures in the transfer position; and (b) actuator means coupled to the transfer control cam means for causing the same to move between the loading and the nonloading position.

10. A conveyor system as defined in claim 6, wherein, in the transfer position, a gripped portion of the signature continuously moves in a rectilinear direction as a respective aligned pair of grip fingers releases the signature and a respective pair of grip jaws grips the signature.

* * * * *